United States Patent [19]

Hertle et al.

[11] Patent Number: 4,923,338

[45] Date of Patent: May 8, 1990

[54] PROCESS FOR LOWERING BUILDING STRUCTURES

[75] Inventors: Edmund Hertle, Planegg; Siegfried Hausner, Munich, both of Fed. Rep. of Germany

[73] Assignee: Alfred Kunz GmbH & Co., Munich, Fed. Rep. of Germany

[21] Appl. No.: 304,152

[22] Filed: Jan. 31, 1989

[30] Foreign Application Priority Data

Feb. 1, 1988 [DE] Fed. Rep. of Germany ..... 3802910

[51] Int. Cl.[5] ..... E02D 17/02

[52] U.S. Cl. ..... 405/229; 405/230

[58] Field of Search ..... 405/229, 230, 196, 197, 405/198, 199; 254/29 R

[56] References Cited

U.S. PATENT DOCUMENTS

| | | | |
|---|---|---|---|
| 957,844 | 5/1910 | Breuchaud | 405/230 |
| 1,005,693 | 10/1911 | Clark | 405/230 X |
| 1,827,921 | 10/1931 | White | 405/230 |
| 3,685,301 | 8/1972 | Heacox | 405/230 |
| 3,796,055 | 3/1974 | Mahony | 405/230 |

OTHER PUBLICATIONS

Underpinning the Cross Building, Fifth Avenue, New York Engineering News, 1912, vol. 68, No. 25, pp. 1134–1135.

*Primary Examiner*—Dennis L. Taylor

*Attorney, Agent, or Firm*—Fleit, Jacobson, Cohn, Price, Holman & Stern

[57] ABSTRACT

The process herein disclosed to lower into the ground building structures, such as shutdown nuclear power plants or building structures to be erected as they are lowered. A caisson for supporting the building structure is provided below the bed plate of the building structure, and is lowered in steps together with the building structure. To permit a controlled lowering of the building structure by a predeterminable distance, the caisson is provided with a reinforced concrete top plate and with a reinforced concrete outer ring which depends from the rim of the top plate and constitutes an outer cutting edge. An inner reinforced concrete ring, which constitutes an inner cutting edge is arranged approximately on the same level as the outer ring. Hydraulic presses are placed between the top surface of the inner ring and the bottom surface of the top plate and are used to support the top plate on the inner ring. The soil between the rings is excavated with the presses extended and, a lowering sequence is initiated by retracting the presses so that the structure descends toward the inner ring. Soil is excavated from below the inner ring and the presses are again extended to push the inner ring further into the ground. The lowering sequence can then be repeated.

3 Claims, 5 Drawing Sheets

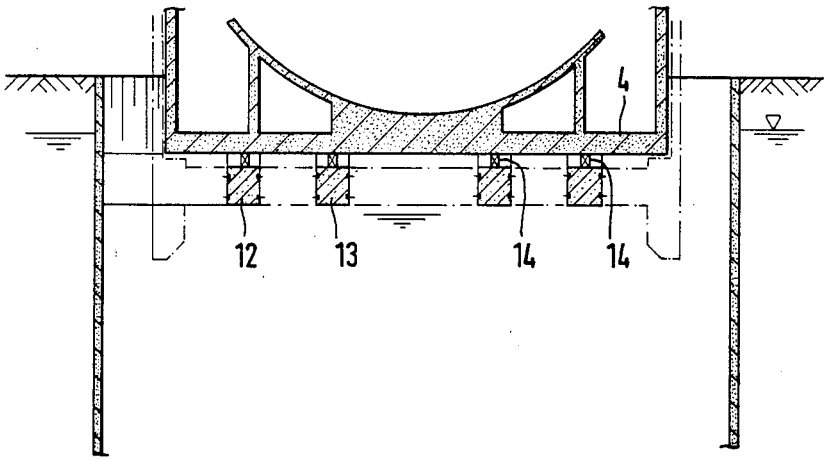
FIG. 2
FIG. 3
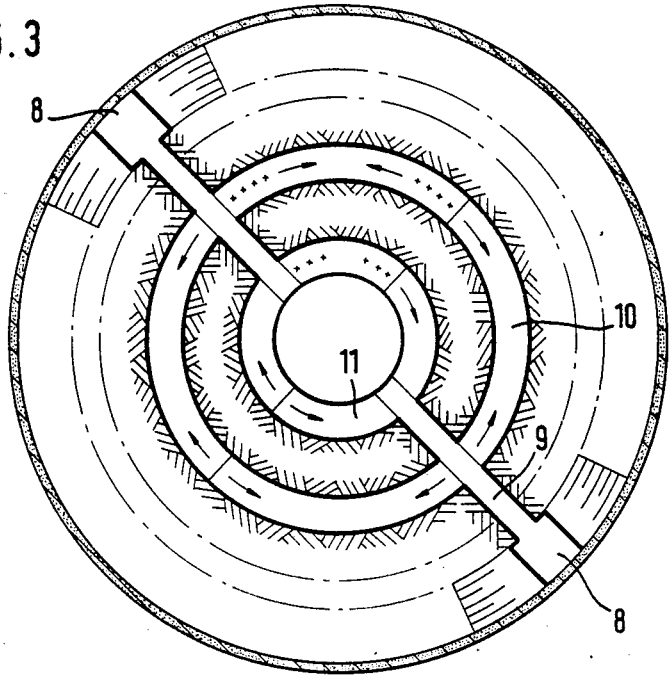

PROCESS FOR LOWERING BUILDING STRUCTURES

BACKGROUND OF THE INVENTION

1. Field of the Invention

This invention relates to a process for lowering into the ground building structures, such as shutdown nuclear power plants or building structures to be erected as they are lowered, wherein a caisson having a top plate for supporting the building structure is provided below the bed plate of the building structure and is lowered in steps together with the building structure.

2. Description of the Prior Art

A process of the above kind for lowering nuclear power plants or reactor parts of nuclear power plants is disclosed in German Patent Specification No. 28 54 330.

In the lowering of building structures together with caissons, the ground within a space defined by the top plate and the cutting edge rings of the caisson generally is excavated until the caisson subsides under the weight of the building. A lowering step is effected when sufficient soil has been excavated that the pressure applied to the caisson overcomes frictional forces acting on the outside surfaces of the cutting edges, the bearing reaction acting on the cutting edges and the internal pressure in the caisson, which internal pressure may be a hydrostatic pressure or pressure applied by compressed air to displace underground water. This means that the caisson will descend at times which cannot be exactly predetermined and by varying distances when sufficient soil has been excavated such that the caisson can descend.

Such uncontrolled descent of the caisson is not desirable when building structures which are, e.g., 60 meters in diameter, are to be lowered.

For this reason it is an object of the invention to provide a process of the kind described which can be used for controlled lowering of building structures by predeterminable distances.

SUMMARY OF THE INVENTION

In a process in accordance with the invention a reinforced concrete caisson top plate is constructed and is provided with a reinforced concrete outer ring, which depends from the rim of the top plate to constitute an outer cutting edge. An inner reinforced concrete ring, which constitutes an inner cutting edge and is inwardly spaced from the ring which constitutes the outer cutting edge is constructed and is arranged approximately on the same level as the outer ring. Hydraulic presses are placed between the top surface of the inner ring and the bottom surface of the top plate and are used to support the top plate on the inner ring. Soil from between the rings is excavated while the presses are extended and a lowering is performed in that the presses are then retracted to relieve the inner cutting edge so that the outer cutting edge and the remainder of the structure descend in a controlled manner toward the inner edge under the higher pressure then acting thereon. The presses are then extended to apply a downward load to the inner cutting edge, when a lowering by the desired distance has been effected or the safety against shear fracture has been reached at the outer cutting edge, and if necessary, after soil is excavated to a desired depth from beneath the inner cutting edge so as to permit the inner cutting edge, to be pushed further down into the ground. The procedure can then be repeated so that the cutting edges perform their lowering steps in alternation. A process in accordance with the invention permits controlled lowering of the caisson and the building structure resting thereon by a controlled shifting of the load from the inner cutting edge to the outer cutting edge and vice versa. When the presses have been retracted to such an extent that the outer cutting edge no longer descends, the inner cutting edge is exposed by excavation of soil from under the inner edge and the presses are then extended until the inner edge again rests on the soil under the desired pressure. At the same time or thereafter the outer cutting edge is exposed by excavation of soil thereunder and the lowering is performed in alternating steps.

As the presses are retracted and relieved, the outer cutting edge is subjected to a higher load as the load is shifted and a higher load is applied to the outer cutting edge and causes the caisson to subside. When the presses resting on the inner cutting edge are relieved, the caisson can be lowered until the safety against shear fracture has been reached again. The lowering can be controlled and can be interrupted at any time by means of the presses acting on the inner cutting edge.

When the outer cutting edge has been lowered by a partial step until the safety against shear fracture has been reached, the presses are extended to apply load to the inner cutting edge, which with the assistance of the excavation will be pressed into the ground. The sequence can be continued until the safety against shear failure has been reached or the presses are relieved. The outer cutting edge can take up higher loads than the inner edge due to its larger area. Whereas the inner cutting edge can carry only part of the load that can be taken up by the outer cutting edge, this will be sufficient for the lowering to be performed in the alternating steps described.

The rings which constitute the outer and inner cutting edges may be circular cylindrical and concentric to each other. Alternatively, the rings may have a different configuration, for example quadrangular.

The inner cutting edge may consist, for example, of two or more cutting edges, which may be parallel or extend at an angle to each other, because such cutting edges have substantially the function of supporting feet which enable a controlled lowering of the caisson.

The process in accordance with the invention can be carried out to lower existing building structures and to lower building structures which are erected as they are lowered. It must be taken into account that when existing building structure are to be lowered, the highest pressure will act on the caisson as the lowering begins and that pressure will decrease owing to the frictional forces as the depth which has been reached increases. In the handling of building structures to be erected while being lowered, the lowest pressure will be applied when the lowering begins.

In accordance with a further feature of the invention, hydraulic presses which support the bed plate of the building structure are placed between the top plate of the caisson and the bed plate. The force of these presses is adapted to be controlled or automatically controlled to ensure a substantially equal load on the bed plate per unit of area thereof. By suitable control or automatic control of the presses it is possible to ensure that the bed plate of the building structure will not be overstressed with formation of cracks by an asymmetrically applied load.

In accordance with a further feature of the invention, the presses acting on the inner cutting edge can be controlled individually to produce an a symmetrical pressure profile around the inner cutting edge. In this way, partial segments of the ring can be subjected to higher loads for cutting into, oblique harder soil strata for example.

A caisson is known which has a cutting edge that can be advanced by presses accommodated in niches and which is caused to follow up in that the presses are relieved.

By contrast, the basis of this invention resides in that the caisson is provided with two cutting edges so that the caisson can be lowered in alternating steps. If the caisson has a large top plate, it will be of special advantage that the inner cutting edge supports the top plate in its central region. The bearing reaction will basically be maintained in that case even when the presses by which the top plate is supported on the inner cutting edge are relieved, because a certain bearing reaction will be maintained even during the relieving step.

The top plate of the caisson may have, for example, a thickness of 3 to 4 meters and may be 60 meters or larger in diameter. The thicknesses of the cutting edge rings of the caisson may have approximately the same thickness as the top plate rings. The cutting edge may additionally be provided at the top with supporting bars.

BRIEF DESCRIPTION OF DRAWINGS

FIG. 2 to 7 illustrate steps for constructing a reinforced concrete caisson under the power plant, and which consists of a top plate and two concentric cutting edge rings.

DESCRIPTION OF PREFERRED EMBODIMENT

Figure 1:
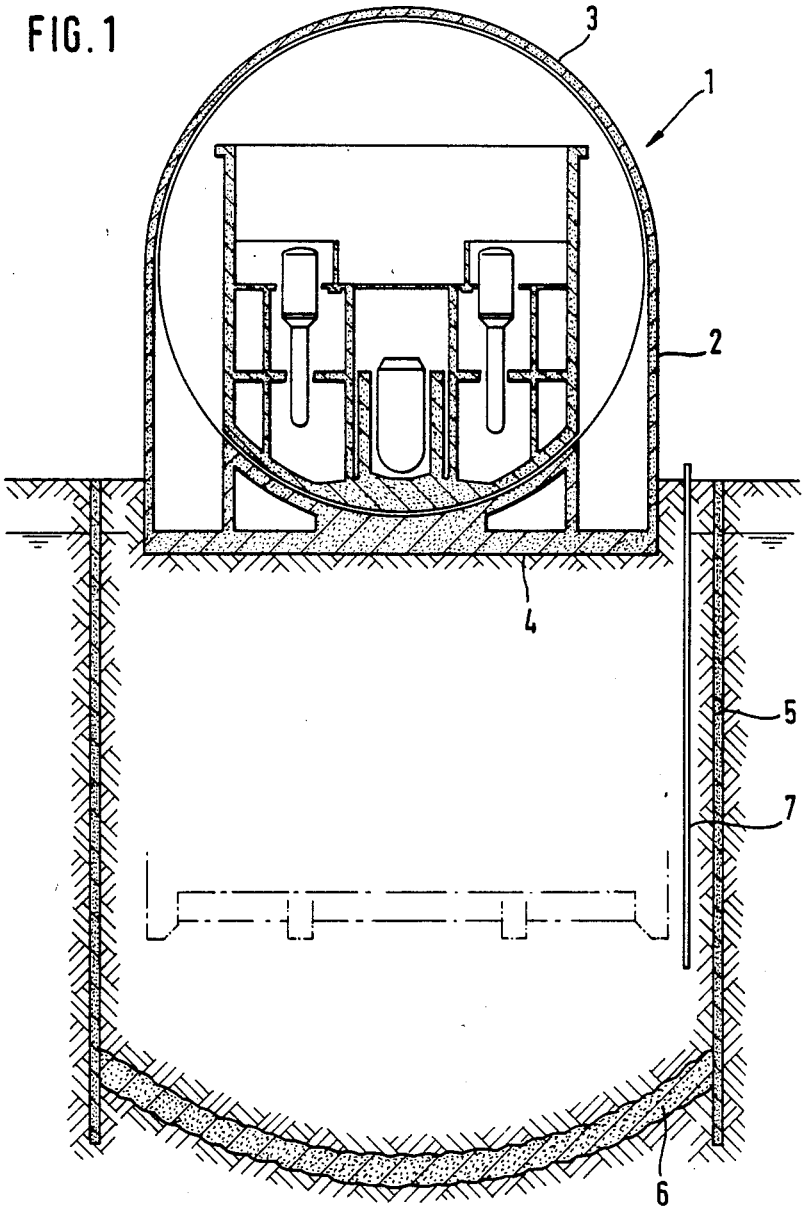
FIG. 1 is a somewhat diagrammatic vertical sectional view of a nuclear power plant, which is to be lowered into the ground and is surrounded by a cylindrical diaphragm wall.
Figure 4:
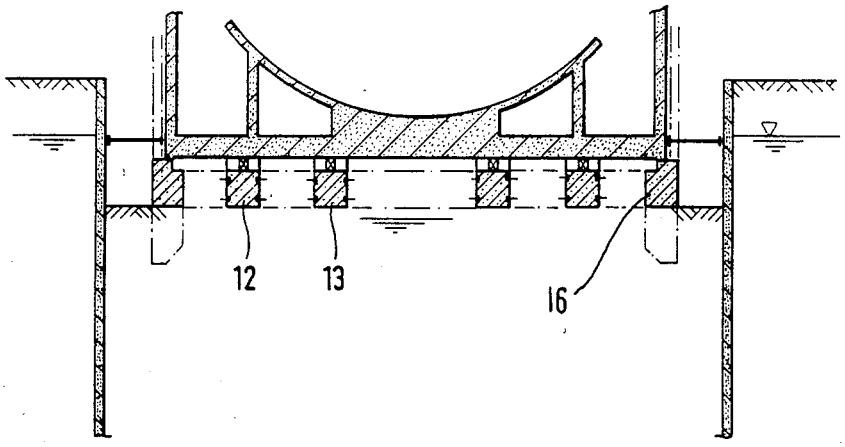

An illustrative embodiment of the invention will now be explained in detail with reference to the drawings.

The nuclear power plant 1 which is to be lowered comprises a cylindrical outer wall 2 provided with a hemishperhical dome 3 and a bed plate 4, which consists of a circular disk. In a first step the nuclear power plant 1 is surrounded by a cylindrical diaphragm wall 5, which extends to a depth of about 75 meters and may have a thickness of up to 1.2 meters. The cylindrical diaphragm wall is provided in its lower region with a water-tight sole 6, by injection of a cement suspension. The sole 6 may be about 3 meters thick. The underground water level in the resulting pot may be lowered in known manner by wells 7.

Figure 5:
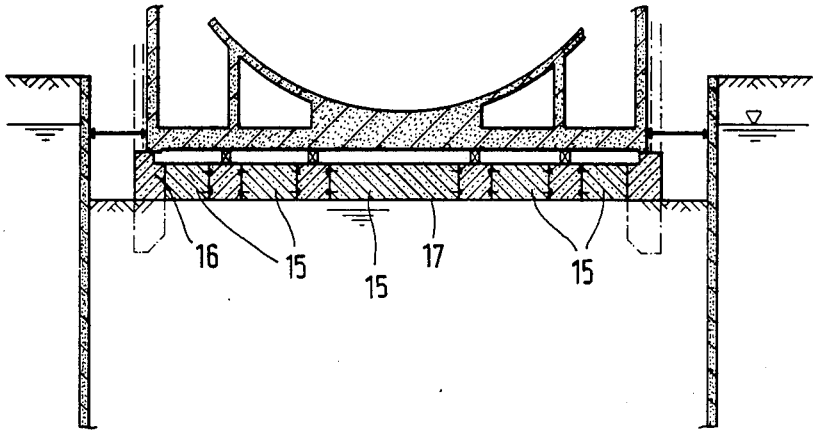
Figure 6:
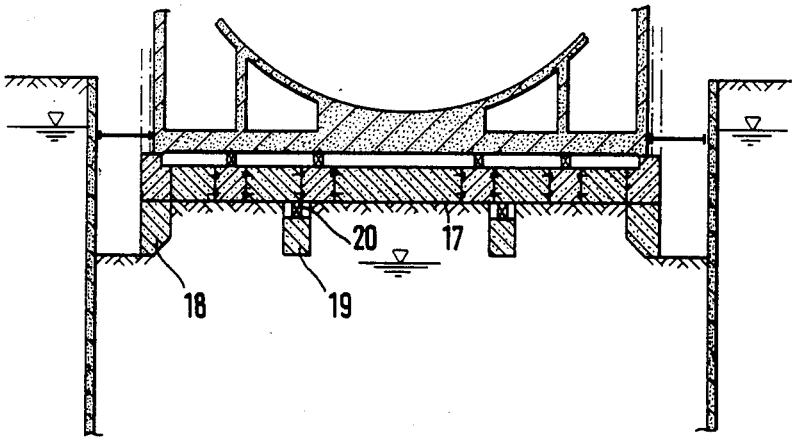
Figure 7:
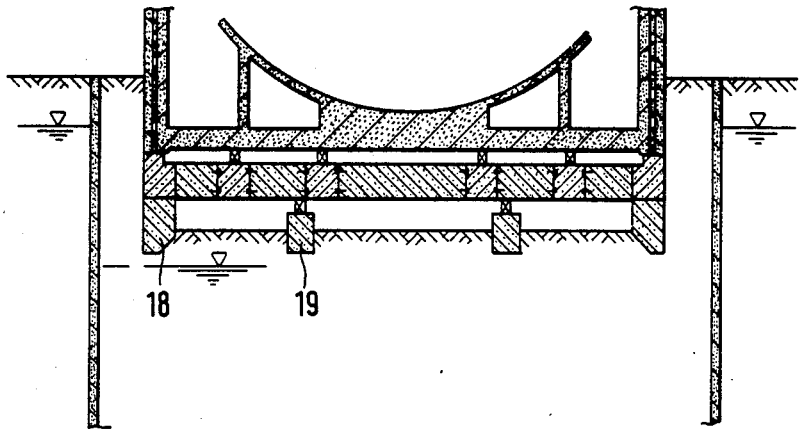

When the surrounding diaphragm wall 5 has been provided, the top plate of a caisson comprising a top plate, and cutting rings is constructed below the bed plate 4 of the nuclear power plant. The top plate 17 is made by mining technology as follows. Transfer ducts 8 are first sunk on mutually opposite sides and are interconnected below the bed plate 4 by radial tunnels 9, which intersect the axis of the building structure. Concentric annular tunnels 10, 11 are dug, which extend from the tunnels 9. Reinforced concrete rings 12, 13 are then constructed in the annular tunnels 10, 11. Equally spaced apart hydraulic presses 14 are placed between the rings 12, 13 and the bed plate 4. The soil between the rings 12, 13 and the central core region within ring 13 are then excavated and the excavated spaces filled with reinforced concrete sections 15 in the manner shown in FIG. 5. The resulting slab of reinforced concrete is surrounded by an outer ring 16 of reinforced concrete, which directly supports the bed plate 4 of the nuclear power plant on its rim. The several parts 12, 13, 15 and 16 of the top plate 17 are firmly joined to provide a homogeneous top plate, which is about 60 meters in diameter. Under the top plate, rings 18 and 19 (FIG. 6) which constitute outer and inner cutting edges are then also made by mining technology. The ring 18 which constitutes the outer cutting edge is directly connected to the underside of the top plate 17 at its rim, as is shown. The inner ring 19, which constitutes the inner cutting edge, supports the central region of the top plate 17 by means of spaced apart hydraulic presses 20 provided on the central region. As a result, the inner cutting edge 19 is movable relative to the top plate 17.

Figure 8:
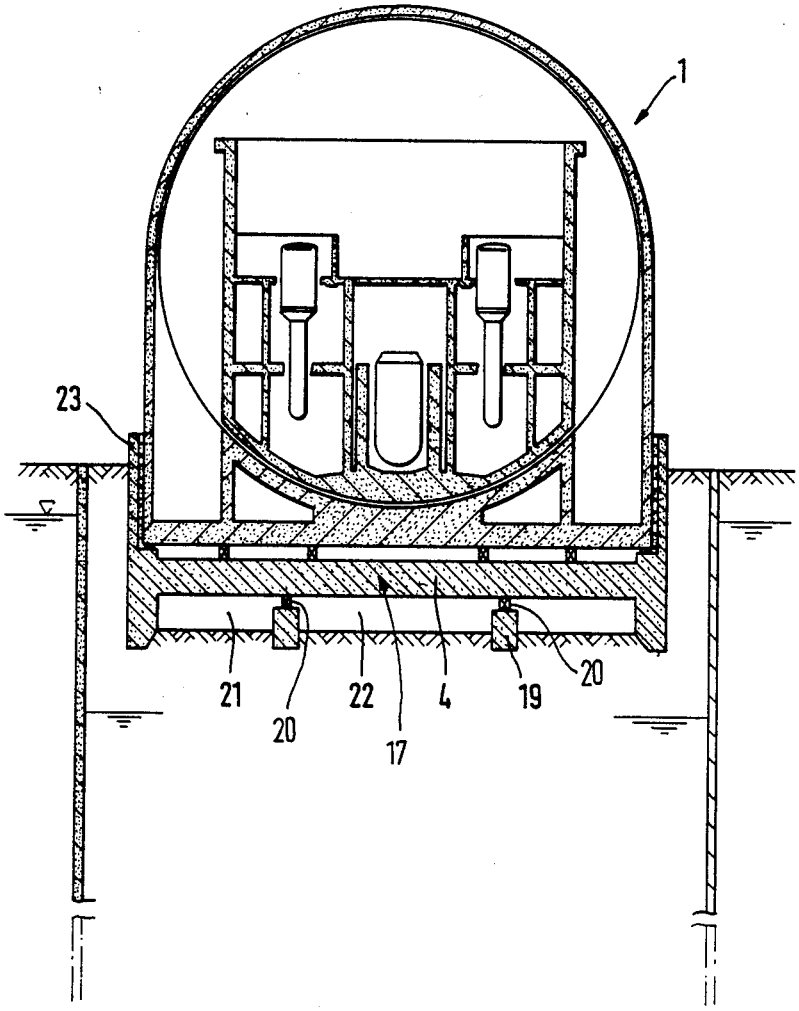
FIG. 8 shows the caisson and the power plant in a partly lowered position.

When the caisson has been made, the nuclear power plant is lowered in steps in that soil is excavated in the working chambers 21, 22 of the caisson (FIG. 8) and the inner cutting edge 19 is alternatively relieved and loaded by retraction and extension of presses 20. More particularly, when soil is excavated from chambers 21 and 22, the presses are in the extended position. After excavation the presses are retracted or relieved of pressure so that the entire structure descends towards ring 19. Then, presses 20 are extended to push ring 19 further down into the ground with prior excavation of soil from below ring 19 as required to complete a lowering cycle. The cycle can then be repeated to perform another lowering step. Along with the progressive lowering of the structure, a circular cylindrical reinforced concrete wall 23 which serves as an additional seal and which is connected to the top plate 17 of the caisson and surrounds the nuclear power plant, may be constructed.

What is claimed is:

1. A process for lowering into the ground a building structure, such as a shutdown nuclear power plant or a building structure to be erected as it is lowered, comprising constructing a caisson below a bed plate of the building structure for lowering in steps together with the building structure, the caisson having a top plate provided with an outer ring which depends from a rim portion of the top plate and constitutes an outer cutting edge, and an inner ring which constitutes an inner cutting edge and is inwardly spaced from the outer ring, the inner ring being disposed substantially on the same level as the outer ring, locating extendable/retractable hydraulic presses between a top surface of the inner ring and a bottom surface of the top plate to support the top plate on the inner ring, and performing a lowering sequence which includes the steps of excavating soil from between the rings with the presses extended, allowing the presses to retract so that the outer ring, the top plate and the building structure descend toward the inner ring, excavating soil from under the inner ring, and extending the presses so that the inner ring is pushed into the ground and the sequence can be repeated.

2. A process according to claim 1, which includes the steps of placing further hydraulic presses, for supporting the bed plate of the building structure, between the top plate of the caisson and the bed plate, said further presses being controllable to provide a substantially equal load on the bed plate per unit of area thereof.

3. A process according to claim 1, characterized in that the presses acting on the inner cutting edge can be controlled individually to produce an asymmetrical pressure profile around the inner cutting edge.

* * * * *